US009145744B2

(12) United States Patent
Jordan, Jr.

(10) Patent No.: US 9,145,744 B2
(45) Date of Patent: Sep. 29, 2015

(54) PLUG AND PERFORATE USING CASING PROFILES

(71) Applicant: Henry Joe Jordan, Jr., Willis, TX (US)

(72) Inventor: Henry Joe Jordan, Jr., Willis, TX (US)

(73) Assignee: DOWNHOLE INNOVATIONS LLC, Houston, TX (US)

( * ) Notice: Subject to any disclaimer, the term of this patent is extended or adjusted under 35 U.S.C. 154(b) by 279 days.

(21) Appl. No.: 13/833,488

(22) Filed: Mar. 15, 2013

(65) Prior Publication Data

US 2014/0262331 A1 Sep. 18, 2014

(51) Int. Cl.

| | |
|---|---|
| ***E21B 17/08*** | (2006.01) |
| ***E21B 23/02*** | (2006.01) |
| ***E21B 43/119*** | (2006.01) |

(52) U.S. Cl.

CPC ..... *E21B 17/08* (2013.01); *E21B 23/02* (2013.01); *E21B 43/119* (2013.01)

(58) Field of Classification Search

CPC ..... B21B 17/08; B21B 43/119; B21B 23/02; B21B 17/046; B21B 17/06; B21B 23/00; B21B 23/06; B21B 33/0407; B21B 43/14

See application file for complete search history.

(56) References Cited

U.S. PATENT DOCUMENTS

| | | | | | |
|---|---|---|---|---|---|
| 3,856,081 | A | * | 12/1974 | Canalizo | 166/123 |
| 4,614,233 | A | * | 9/1986 | Menard | 166/206 |
| 5,996,711 | A | * | 12/1999 | Ohmer | 175/61 |
| 6,012,527 | A | * | 1/2000 | Nitis et al. | 166/313 |

OTHER PUBLICATIONS

PCT International Search Report for PCT/US2014/020676, Jun. 25, 2014.

* cited by examiner

*Primary Examiner* — Yong-Suk (Philip) Ro
(74) *Attorney, Agent, or Firm* — The Kubiak Law Firm, PLLC

(57) ABSTRACT

In order to overcome the need to remove each fracturing plug after a plug and perforate operation it is desirable to utilize a profile latch in conjunction with a coupling profile. By having a profile in each coupling or at least in predetermined couplings a tool such as a perforating assembly including a fracturing plug may be precisely placed. A profile in the couplings also provides a means to latch the perforating assembly or other tool securely to the casing without using slips. Such profiles typically provide for securing the tool or perforating assembly in one direction although a particular profile may secure the assembly in place in two directions. By securing the tool or perforating assembly in one direction only the tool may be easily relocated or removed from the casing.

29 Claims, 7 Drawing Sheets

PLUG AND PERFORATE USING CASING PROFILES

BACKGROUND

In the course of producing oil and gas wells, typically after the well is drilled, the well may be completed. In many instances, in order to complete the well the well may be cased. In certain instances the process of installing casing into the wellbore may begin with a cement float shoe threaded to a coupling and the coupling is threaded onto the first joint of casing. Typically, each joint of casing is about thirty feet long with a pin connection on each end. A coupling typically has a box connection on both ends. As the casing is lowered into the well a coupling is attached between each joint of casing to allow the joints of casing to be threaded together.

Once the casing is located at the appropriate position in the wellbore cement may be pumped into and down the interior of the casing. The cement may both anchor the casing into position as well as isolate the hydrocarbon bearing formation from another section of the same formation or from other formations that are penetrated by the same wellbore. Once the cement reaches the cement float shoe the cement flows out of the casing and then into the annular area outside of the casing between the casing and the wellbore. The cement is forced into the annular area generally until the annular area is filled with cement. Once an appropriate amount of cement is pumped into the casing a wiper plug may then be used push the cement out of the casing and to eliminate as much of the remaining cement as possible from the interior of the casing.

Generally the next step in completing the well, after the cement is allowed to set or cure is to form ports in the casing to allow the fluids from the formation into the interior of the casing. One of the current methods of forming the ports in the casing is known as plug and perforate. Typically, fracturing operations in oil and gas wells today involve fracturing plugs. Fracturing plugs are typically deployed on electric line in combination with perforating guns and a plug setting tool. The operator uses the weight of the fracturing plug, perforating guns, and plug setting tool to lower the assembly to the desired location in the well. For highly deviated and horizontal wells, gravity will not provide the assistance to move the assembly out in the horizontal lateral section, therefore many operators use a 'pump-down' technique where fluid is pumped into the well above the assembly thereby forcing the assembly into the well and while allowing the electric line to unspool. The operator monitors the length of electric line deployed to determine where the assembly and in particular the fracturing plug is located in the well. Once the assembly reaches the desired setting location, the surface pumps are stopped and the fracturing plug is set by sending an electric signal down the electric line which fires the setting tool. The setting process also releases the plug from the setting tool.

Once the fracturing plug is set within the wellbore, the operator may then perform a second operation to perforate the casing allowing access the adjacent formation. The perforating guns utilize specially designed explosives to perforate the casing allowing access to the adjacent formation above the fracturing plug's pre-determined location. After firing the perforating gun, the operator may move the perforating gun and setting tool up the casing and the perforating gun is again activated. The process may be repeated until all of the perforating gun's sections have been utilized.

After firing all of the desired sections of the perforating gun the operator typically retrieves the electric line and spent perforating guns. Once the electric line and spent perforating guns are removed from the wellbore the operator may then rig up the surface piping to conduct pressure fracturing operations through the new perforations and into the formation with the fracturing plug that was placed into the casing isolating that portion of the casing below the fracturing plug and allowing only the portion of the formation that was accessed by the perforating gun to be fractured Formation fracturing occurs when the fracturing fluid, pressurized from surface using high-pressure pumps, creates a pressure greater than the natural reservoir pressure contained in the formation. This process is commonly known as 'fracturing the well.' The pressurized fluid will be diverted by the fracturing plug through the perforations in the casing, therefore the fracturing fluids will be forced out into the formation of interest. Fracturing the reservoir causes cracks and fissures to occur in the rock containing the hydrocarbon, and thus releases the oil or gas to flow into the well bore for easier production.

After fracturing the formation a new perforation assembly is run into the casing where the new fracturing plug is set above the section previously perforated and the entire process is repeated until the desired number of perforations has been completed and the associated portions of the formations have been fractured and treated.

Once the process is complete the fracturing plugs must be removed, typically by milling or drilling out each fracturing plug. It is not unusual for there to be ten or more fracturing plugs that must be removed before the well may be produced. Removing each fracturing plug by milling it out takes a substantial amount of rig time incurring substantial cost. Typically this is accomplished by running a motor and mill assembly on the bottom of either coil tubing or on threaded pipe. Each previously installed fracturing plug may be completely milled up, or removed, from the wellbore. The milling operation may be expensive and can sometimes cost hundreds of thousands of dollars to remove all of the plugs so the well can be placed into production.

SUMMARY

It may be desirable to be able to remove the fracturing plugs from the casing without milling out each fracturing plug. It is also desirable to anchor a fracturing plug or other wellbore device in the casing without slips that may damage the interior surface of the casing.

By having a coupling with a particular profile in the internal diameter the fracturing plug may be precisely located during the initial fracturing process. Additionally, in the event the operator desires to re-fracture the well the same profile may be used, again precisely locating the fracturing plug. Each desired coupling profile could be an individual profile allowing only a particular fracturing plug to locate at into the particular coupling profile.

In another embodiment using multiple couplings, each having the same profile but located along the tubing string at each desired location would allow each fracturing plug to be located at a different location without requiring a particular coupling with a particular profile to be located consuming undue costs or time. Thereby allowing the operator to have only a single type of profiled coupling and a single type of fracturing plug at the wellsite.

In certain instances the operator may not locate a coupling profile in each coupling but may spread those couplings with a profile over the length of the tubing string interspersing non-profiled couplings in between.

The coupling profiles are preferably used for both locating the fracturing plug but also as a means for securing the fracturing plug in the casing or tubing. While the preferred embodiment utilizes a fracturing plug the profiles could be used to secure any equipment that the operator desires in the casing or tubing assembly. Additionally while the preferred embodiment utilizes a profile in a coupling it would also be possible to locate a profile in any or all of the casing joints.

In one embodiment of the present invention profile latch for locking into a casing coupling may be provided where a casing assembly may have at least two casing joints and at least one casing coupling. The casing coupling may have at least one profile where the profile latch may have at least one dog corresponding to the profile to lock into the profile. The dog is locked into the profile by a cam. The profile may be at least partially circumferential or it may include at least one longitudinal slot. The profile may have a lower surface perpendicular to the longitudinal axis of the coupling. The dog may have a lower surface and the profile may have a lower surface each having an angle that cooperate to apply a radially outward force to the dog when a down force may be applied to the dog. The dog may have an upper surface and the profile may have upper surfaces each having angles that cooperate to apply a radially inward force to the dog when an upward force may be applied to the dog.

In another embodiment of the present invention a method may be provide to lock a profile latch into a coupling. The method provides for assembling a casing assembly, where the casing assembly may have at least two casing joints and at least one casing coupling. The casing coupling may have at least a first and a second profile and the second profile may be located above the first profile. The casing assembly may be run into a wellbore and then cemented into the wellbore. Next a profile latch may be run into the casing assembly. The profile latch may have at least one dog corresponding to the profile to lock into the first and the second profile. The profile latch may be then located adjacent the first profile after which the profile latch may be locked into the first profile. An upwards force may be applied to the profile latch to release the profile latch from the first profile after which the profile latch may be moved from the first profile to the second profile. The profile latch may then be locked into the second profile. An upwards force may be applied to the profile latch to release the profile latch from the second profile after which the profile latch may be retrieved from the casing assembly. The first and the second profiles may be at least partially circumferential and may include at least one longitudinal slot. The first profile and the second profile correspond to the same profile latch. The first and the second profiles may have a lower surface perpendicular to the longitudinal axis of the coupling. The dog may have a lower surface and the first and the second profiles each may have a lower surface having an angle that cooperate to apply a radially outward force to the dog when a down force is applied to the dog. The dog may have an upper surface and the first and the second profiles each may have an upper surface having an angle that cooperate to apply a radially inward force to the dog when an upward force is applied to the dog.

In another embodiment of the present invention a method is provided to lock a profile latch into a coupling. The method provides for assembling a casing assembly, where the casing assembly may have at least three casing joints and at least a first casing coupling and a second casing coupling. The first casing coupling may have a first profile and the second casing coupling may have a second profile. The second profile may be located above the first profile. The casing assembly may be run into a wellbore and then cemented into the wellbore. A first profile latch may be run into the casing assembly where the first profile latch may have at least one first dog corresponding to the first profile to lock into the first profile. The first profile latch may be located adjacent the first profile and then locked into the first profile. A second profile latch may be run into the casing assembly where the second profile latch may have at least one second dog corresponding to the second profile to lock into the second profile. The second profile latch may be located adjacent the second profile and then locked into the second profile. The first profile may be at least partially circumferential. The second profile may be at least partially circumferential. The first profile or the second profile include at least one longitudinal slot. The first profile may have a lower surface perpendicular to the longitudinal axis of the casing assembly. The second profile may have a lower surface perpendicular to the longitudinal axis of the casing assembly. The first dog and the second dog each may have a lower surface and the first profile and the second profile each may have a lower surface having an angle that cooperate to apply a radially outward force to the first dog or the second dog when a down force is applied to the first dog or the second dog. The first dog and second dog each may have an upper surface and the first profile and second profile each may have an upper surface each having an angle that cooperate to apply a radially inward force to the first dog or the second dog when an upward force is applied to the first dog or the second dog.

DETAILED DESCRIPTION

The description that follows includes exemplary apparatus, methods, techniques, and instruction sequences that embody techniques of the inventive subject matter. However, it is understood that the described embodiments may be practiced without these specific details.

Figure 1:
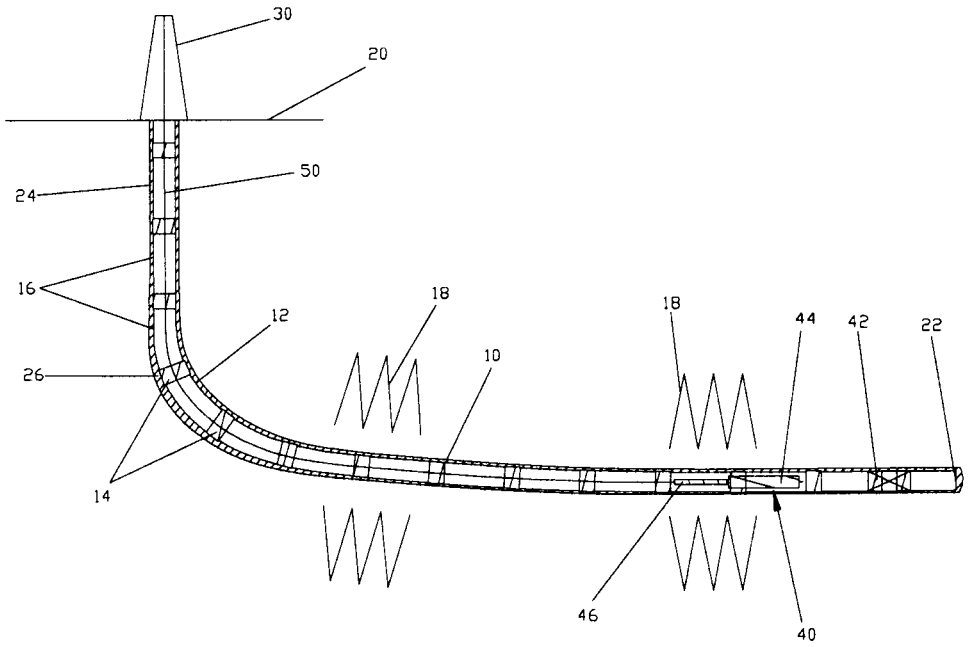
FIG. 1 depicts a cemented wellbore with couplings connecting the casings joints and a perforating gun, a setting tool, and a fracturing plug located in the casing.

FIG. 1 depicts a completion where a wellbore 10 has been drilled through one or more formation zones 18. A casing assembly 12, consisting of casing joints 16 and couplings 14 may be run into the wellbore 10. Typically the casing assembly 12 is made up on the surface 20 with a cement float shoe 22 on the lower end of the casing assembly 12. The casing assembly 12 is then lowered into the wellbore 10 by the rig 30 until the desired depth is reached.

Upon reaching the desired depth, cement 24 is pumped from the surface 20 through the interior of the casing assembly 12, out of the cement float shoe 22, and into the annular area 26 formed between the casing assembly 12 and the wellbore 10. Once a predetermined amount of cement 24 is pumped into the casing assembly 12 at the surface 20 a wiper plug may be pumped down through the casing assembly 12 to push the cement out of the casing assembly 12 and into the annular area 26. Upon setting or curing the cement 24 may anchor the casing assembly 12 into position. The cement may also longitudinally isolate various formations 18 or portions of a formation 18 from one another.

Typically after the casing assembly 12 has been cemented into place a perforating assembly 40 may be run into the casing assembly 12 on e-line 50. The perforating assembly 40, typically has a fracturing plug 42 on the lower end, a setting tool 44 just above the fracturing plug 42, and a multi-stage perforating gun 46 just above the setting tool 44. Once the perforating assembly 40 is properly located power is supplied via the e-line 50 to the setting tool 44 to set the fracturing plug 42.

Provided that the perforating assembly 40 is properly located, when the setting tool 44 is actuated the setting tool 44 causes dogs in the fracturing plug 42 to move outwards to engage the appropriate profile in the interior of the appropriate coupling 14 locking the fracturing plug 42 to the coupling 14. At the same time the setting tool causes the fracturing plug 42 to longitudinally compress sealing the interior of the casing assembly 12 against fluid flow past the fracturing plug 42. The dogs may be any type of device that may transition between a radially outward position to lock the fracturing plug or profile latch in place thereby preventing further downward travel of the fracturing plug or profile latch and a radially inward position unlocking the fracturing plug or profile latch to allow either upwards or downwards movement. Such dogs include collets, snap rings, cams, and fingers.

As shown the setting tool 44 may then be disconnected from the fracturing plug 42 so that the remainder of the bottom hole assembly 40, the setting tool 44 and the multi-stage perforating gun 46 may be raised to the desired location and power supplied to the first stage of the multi-stage perforating gun 46 so that the first stage may be discharged to form ports through the casing 16 and the cement 24 providing access to formation 18. The multi-stage perforating gun 46 may then be moved some distance and the next stage of the multi-stage perforating gun 46 is discharged. The process may be repeated until all of the stages of the multi-stage perforating gun 46 have been discharged.

Typically, once the desired stages of the multi-stage perforating gun 46 have been discharged, the setting tool 42 and the now discharged multi-stage perforating gun 46 are raised to the surface 20. A second or a reloaded multi-stage perforating gun 46 and a second or a reloaded setting tool 44 may then be lowered or pumped back down through the casing assembly 14 until the second setting tool lands on the fracturing plug 42. Upon landing on the fracturing plug 42 the setting tool 44 locks to the fracturing plug allowing the operator to exert upward force on the fracturing plug 42 causing the dogs in the fracturing plug 42 to release and allowing the entire perforating assembly 40 to be raised to the next location to be fractured or treated. Upon reaching the next location to be fractured or treated the now recharged or replaced setting tool 44 is actuated. The setting tool 44 causes dogs in the fracturing plug 42 to move outwards to engage the appropriate profile in the interior of the appropriate coupling 14 locking the fracturing plug 42 to the coupling 14. At the same time the setting tool 44 causes the fracturing plug 42 to longitudinally compress sealing the interior of the casing assembly 12 against fluid flow past the fracturing plug 42. The process is then repeated until each desired formation zone 18 has been fractured or treated.

In another embodiment the setting tool 44 may remain attached to fracturing plug 42. The perforating gun 46 and the setting tool 44 may be spaced apart so that upon power being supplied to the perforating gun 46 the perforating gun 46 may be discharged to form ports through the casing 16 and the cement 24 providing access to formation 18. The formation may then be fractured while leaving the perforating gun 46, the setting tool 44, and the fracturing plug 42 in place. After the fracturing or treating operation is complete the perforating assembly may be raised causing the dogs in the fracturing plugs to release and allowing the entire assembly to be raised.

In another embodiment after the treating or fracturing operation is complete a fracturing plug 42 may remain in place at certain locations in the wellbore 10. With a fracturing plug 42 the well cannot be produced from any formation below the fracturing plug 42 as the inflow of fluids, including hydrocarbons, from the formation 18 is blocked by the fracturing plugs 42 that remain locked to the coupling profiles thereby blocking fluid flow in both directions. The operator will typically run back into the casing assembly 14 with retrieving tool to lock into the upper end of the fracturing plug 42. Once the retrieving tool is locked into the fracturing plug 42 upward force may be applied to release the dogs and the sealing element thereby allowing the fracturing plug 42 free movement through the casing assembly 12.

Typically, each fracturing plug has a latch profile on its upper end to allow a setting tool or any other tool with the appropriate profile to lock in to the fracturing tool 42. Additionally each fracturing tool 42 may also have the appropriate latch profile on its lower end to allow a fracturing plug 42 higher in the well to be lowered to the next lower fracturing plug 42 and lock in to the next lower fracturing plug 42. When upward force is exerted on the next lower fracturing plug said fracturing plug will be released to move through the casing assembly with the higher fracturing plug. In this manner all of the remaining fracturing plugs may be released from the well in a single trip.

Figure 2:
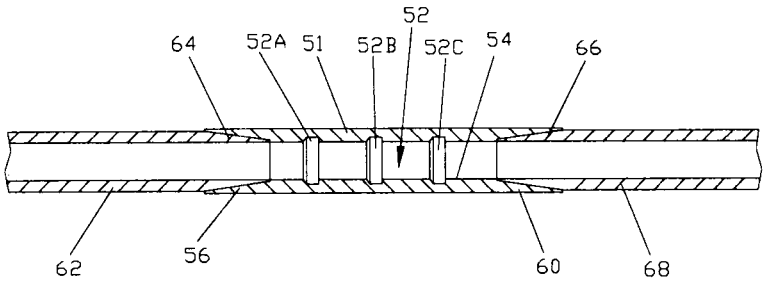
FIG. 2 depicts a coupling profile located on the couplings interior surface.

FIG. 2 depicts a coupling 51 having a profile 52 located on the interior surface 54 of coupling 51. The coupling has a first box end 56 and a second box end 60 so that a first casing joint 62 having a first pin end 64 and a second casing joint 68 having a second pin end 66 may be threadedly attached to the coupling 51 where the first pin end 64 is threaded in to the first box end 56 and the second pin end 66 is threaded in to the second box end 60. In this case the profile consists of three grooves 52A, 52B, and 52C.

Figure 3:
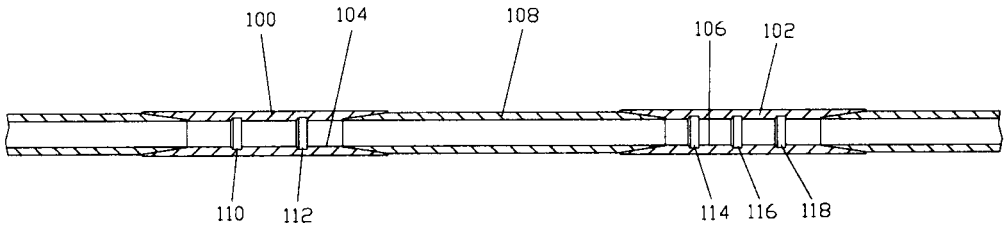
FIG. 3 depicts a first coupling and a second coupling each having an interior surface.

FIG. 3 depicts a first coupling 100 and a second coupling 102 each having an interior surface 104 and 106 respectively. At least one joint of casing 108 separates the couplings 100 and 102 although any number of casing joints could be between the couplings 100 and 102. In the instance that multiple casing joints are used a coupling would be needed between each casing joint, although each coupling would not necessarily have a profile in its interior. As depicted couplings 100 and 102 have different internal coupling profiles. Coupling 100 has a profile with two circumferential grooves 110 and 112 while coupling 102 has a profile with three circumferential grooves 114, 116, and 118. By utilizing couplings 100 and 102, each having a different profile, a fracturing plug or other tool may be set at a particular point in the casing assembly so long as the fracturing plug or other tool is provided with a locking profile or set of dogs that correspond to the particular coupling profile where the tool is to be latched. In this case a fracturing plug having a three dog locking profile would pass by coupling 100 without latching into the circumferential grooves 110 and 112 but would continue downhole to coupling 102 where the fracturing plug would be able to lock in to the corresponding circumferential grooves 114, 116, and 118. A following fracturing plug or other tool may then utilize the coupling 100 and latch into grooves 110 and 112. While the profiles depicted are circumferential grooves, any type or combination of profiles may be utilized, including but not limited to one or more circumferential grooves, partially circumferential grooves, offset partially circumferential grooves, slots, or any combination thereof.

Figure 4:
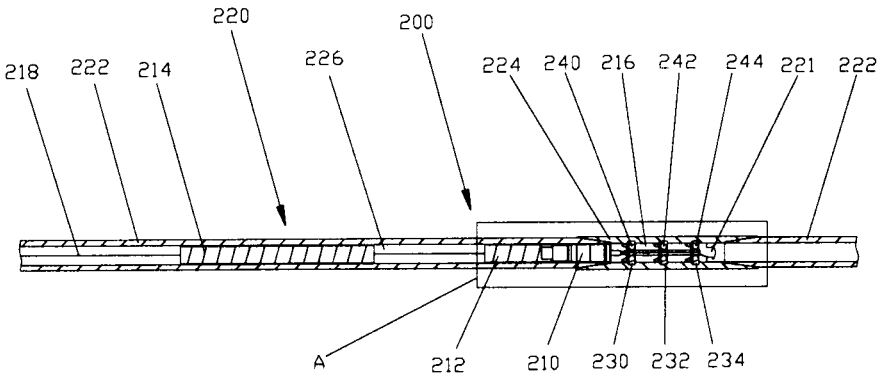
FIG. 4 depicts a perforating assembly located adjacent to a coupling profile but not yet actuated.

FIGS. 4, 5, 6, and 7 depict a perforating assembly 200 in its run in condition and in its set condition. FIG. 4 depicts a fracturing plug 210, a setting tool 212, a multi-stage perforating gun 214, and a profile latch 216 run into a casing assembly 220 on an electric line 218. The casing assembly 220 has at least one casing joint 222, a profile coupling 224, and an interior passage 226. The profile latch 216 has a male retrieving latch 221 on its lower end so that upon being released from the profile coupling 224, it may be lowered to latch into a matching female retrieving latch on the upper end of a second profile latch that may remain lower in the wellbore. Typically, each profile latch will be retrieved by the setting tool 212 that is run into the wellbore with the profile latch 216. Typically each setting tool 212 has a male retrieving latch on its lower end that mates with the female retrieving latch in each profile latch to allow the setting tool 212 to actuate and retrieve each profile latch 216.

Figure 5:
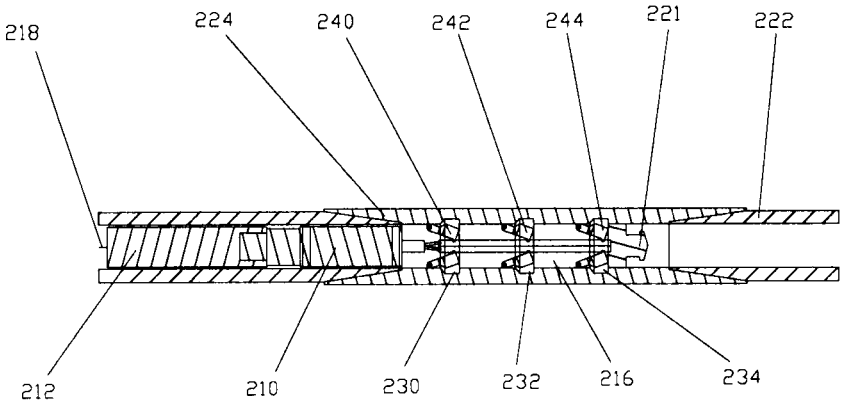
FIG. 5 depicts a close up of the coupling profile and profile latch, not yet actuated.

As can be seen more readily in FIG. 5, which is area A of FIG. 5, the profile coupling 224 has three circumferential grooves 230, 232, and 234. In this instance the profile latch 216 has three dogs 240, 242, and 244 that are located adjacent to circumferential grooves 230, 232, and 234. Upon a signal from the operator the setting tool 212 will fire to actuate the sealing assembly in the fracturing plug 210, the dogs 240, 242, and 244 in the profile latch 216, and to disconnect the setting tool 212 from the fracturing plug 210 and the profile latch 216.

Figure 6:
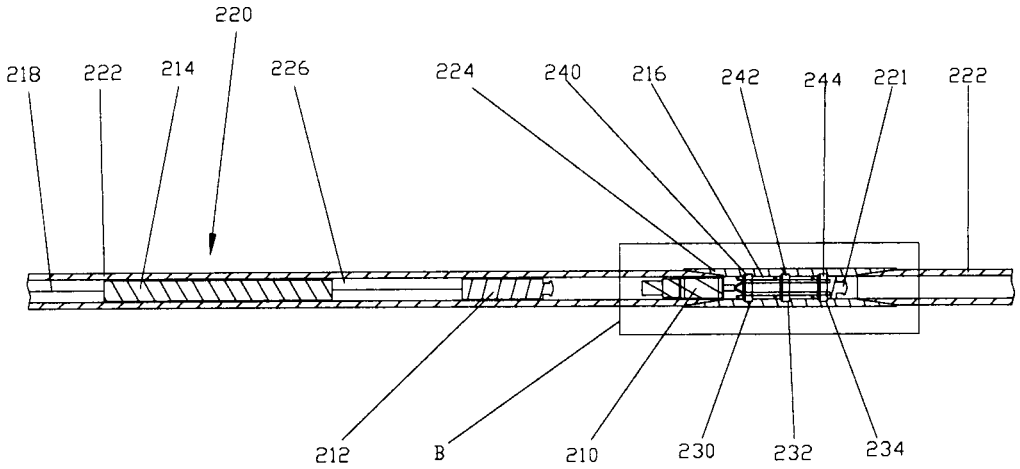
FIG. 6 depicts a perforating assembly located adjacent to a coupling profile but not yet actuated.

FIG. 6 depicts the perforating assembly 200 after the setting tool 212 has been actuated. The setting tool 212 is disconnected from the fracturing plug 210, the fracturing plug 210 is sealing the interior 70 of the casing assembly 10, and the profile latch 216 is engaged with the matching profile coupling 224.

Figure 7:
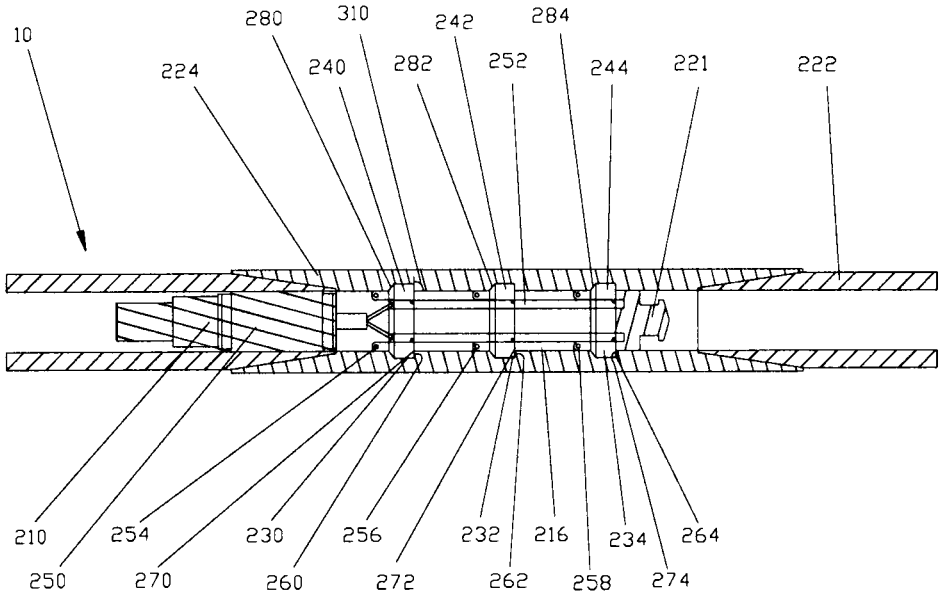
FIG. 7 depicts a close up of the coupling profile and profile latch, not yet actuated.

As can be more readily seen in FIG. 7, which is area B from FIG. 6, with the fracturing plug 210 set the sealing element 250 is forced radially outward as the sealing element 250 is longitudinally compressed. The sealing element 250 is extruded radially outward until it contacts the casing assembly 10 to seal the interior of the casing assembly against fluid flow past the sealing element 250. Additionally the dogs 240, 242, and 244 in the profile latch 216 are moved outward to engage the circumferential grooves 230, 232, and 234 in the profile coupling 224. Rod 252 is attached to each dog 240, 242, and 244. As the rod 252 moves downwards each dog 240, 242, and 244 is rotated about a pivot point 254, 256, and 258 such that the outer surface of each dog 240, 242, and 244 engages each circumferential groove 230, 232, and 234. The lower surface 260, 262, and 264 of each circumferential groove 230, 232, and 234 is generally perpendicular to the longitudinal axis of the casing assembly 10 so that the matching surface 270, 272, and 274 on the lower end of each dog 240, 242, and 244 will resist further downward movement of the fracturing plug 210 and profile latch 216 when pressure is applied against the fracturing plug.

In some instances the lower surface 260, 262, and 264 of the grooves 230, 232, and 234, respectively, may have an angle such as angle 310 that is an acute angle. Each lower surface 312, 314, and 316 of dogs 240, 242, or 244, respectively, corresponding to each groove 230, 232, and 234 may have an angle 310 that is acute to the longitudinal axis of the casing assembly. With at least one groove 230, 232, and 234 having an angle 310, such that as a corresponding dog 240, 242, and 244 is forced downward by pressure applied from above, such as hydraulic fracturing pressure, the dogs 240, 242, and 244 will be forced radially outward further locking the fracturing plug 210 and the profile latch 216 in position.

In the embodiment depicted the upper surface 280, 282, and 284 of each circumferential groove 230, 232, and 234 is generally angled so that when force is applied in the upwards direction the angled upper surfaces 280, 282, and 284 will tend to force the dogs 240, 242, and 244 to move inwards releasing the profile latch 216 as well as the fracturing plug 210 so that both the fracturing plug 210 and the profile latch 216 may be moved upwards to the next location or removed from the well.

Bottom, lower, or downward denotes the end of the well or device away from the surface, including movement away from the surface. Top, upwards, raised, or higher denotes the end of the well or the device towards the surface, including movement towards the surface. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A profile latch for locking into a casing coupling comprising:

a casing assembly having at least two casing joints and at least one casing coupling, wherein the casing coupling has at least one profile, a fracturing assembly having a fracturing plug, a setting tool, and a perforating gun, wherein the fracturing plug has a profile latch having at least one dog corresponding to the profile, wherein the dog has a lower surface and the profile has a lower surface each having an angle that cooperate to apply a radially outward force to the dog in reaction to a down force applied to the dog, wherein the dog has an upper surface and the profile has an upper surface each having an angle that cooperate to apply a radially inward force to the dog in reaction to an upward force applied to the dog, further wherein the setting tool causes the profile latch to move between a locked condition and an unlocked condition.

2. The profile latch of claim 1 wherein the profile is at least partially circumferential.

3. The profile latch of claim 1 wherein the dog is locked into the profile by a cam.

4. The profile latch of claim 1 wherein the profile includes at least one longitudinal slot.

5. The profile latch of claim 1 wherein the profile has a lower surface perpendicular to the longitudinal axis of the coupling.

6. A method of locking a profile latch to a coupling comprising:

assembling a casing assembly, wherein the casing assembly has at least three casing joints and at least a first casing coupling and a second casing coupling, wherein the first casing coupling has at least a first profile and the second casing coupling has a second profile, further wherein the second profile is located above the first profile;

running the casing assembly into a wellbore;

cementing the casing assembly in to the wellbore;

running a fracturing assembly having a fracturing plug, a setting tool, and a perforating gun into the casing assembly, wherein the fracturing plug has a profile latch having at least one dog corresponding to the profile;

locating the profile latch adjacent the first profile;

causing the setting tool to move the profile latch between a locked condition and an unlocked condition in the first profile;

moving the profile latch from the first profile to the second profile; and causing the setting tool to move the profile latch between a locked condition and an unlocked condition in the second profile.

7. The method of claim 6 wherein the first and the second profiles are at least partially circumferential.

8. The method of claim 6 including the step of retrieving the profile latch from the wellbore.

9. The method of claim 6 wherein the first and the second profiles include at least one longitudinal slot.

10. The method of claim 6 wherein the first profile and the second profile correspond to the same profile latch.

11. The method of claim 6 wherein the first and the second profiles have a lower surface perpendicular to the longitudinal axis of the coupling.

12. The method of claim 6 wherein the dog has a lower surface and the first and the second profiles each have a lower surface having an angle that cooperate to apply a radially outward force to the dog in reaction to a down force applied to the dog.

13. The method of claim 6 wherein the dog has an upper surface and the first and the second profiles each have an upper surface having an angle that cooperate to apply a radially inward force to the dog in reaction to an upward force applied to the dog.

14. A method of locking a profile latch to a coupling comprising:

assembling a casing assembly, wherein the casing assembly has at least three casing joints and at least a first casing coupling and a second casing coupling, wherein the first casing coupling has a first profile and the second casing coupling has a second profile, further wherein the second profile is located above the first profile;

running the casing assembly into a wellbore;

cementing the casing assembly in to the wellbore;

running a first fracturing assembly having a fracturing plug, a setting tool, and a perforating gun into the casing assembly, wherein the first fracturing plug has a profile latch having at least one first dog corresponding to the first profile;

locating the first profile latch adjacent the first profile;

causing the setting tool to move the first profile latch between a locked condition and an unlocked condition in the first profile;

running a second fracturing assembly having a second fracturing plug, a second setting tool, and a second perforating gun into the casing assembly, wherein the second fracturing plug has a second profile latch having at least one second dog corresponding to the second profile;

locating the second profile latch adjacent the second profile; and causing the setting tool to move the second profile latch between a locked condition and an unlocked condition in the second profile.

15. The method of claim 14 wherein the first profile is at least partially circumferential.

16. The method of claim 14 wherein the second profile is at least partially circumferential.

17. The method of claim 14 wherein the first profile or the second profile include at least one longitudinal slot.

18. The method of claim 14 wherein the first profile has a lower surface perpendicular to the longitudinal axis of the casing assembly.

19. The method of claim 14 wherein the second profile has a lower surface perpendicular to the longitudinal axis of the casing assembly.

20. The method of claim 14 wherein the first dog and the second dog each have a lower surface and the first profile and the second profile each have a lower surface having an angle that cooperate to apply a radially outward force to the first dog or the second dog in reaction to a down force applied to the first dog or the second dog.

21. The method of claim 14 wherein the first dog and second dog each have an upper surface and the first profile and second profile each have an upper surface each having an angle that cooperate to apply a radially inward force to the first dog or the second dog in reaction to an upward force applied to the first dog or the second dog.

22. A method of locking a profile latch to a coupling comprising:

providing a first casing coupling having a first profile for use in a casing assembly;

providing a second casing coupling having the first profile for use in a casing assembly;

running a fracturing assembly having a fracturing plug, a setting tool, and a perforating gun into the casing assembly, wherein the fracturing plug has a profile latch having at least one dog corresponding to the first profile;

locating the profile latch adjacent the first casing coupling first profile;

causing the setting tool to move the profile latch between a locked condition and an unlocked condition in the first profile adjacent the first casing coupling;

moving the profile latch from adjacent the first casing coupling to adjacent the second casing coupling; and causing the setting tool to move the profile latch between a locked condition and an unlocked condition in the first profile adjacent the second coupling.

23. The method of claim 22 including retrieving the profile latch from the casing assembly.

24. The method of claim 23 wherein the first and the second profiles are at least partially circumferential.

25. The method of claim 23 wherein the first and the second profiles include at least one longitudinal slot.

26. The method of claim 23 wherein the first profile and the second profile correspond to the same profile latch.

27. The method of claim 23 wherein the first and the second profiles have a lower surface perpendicular to the longitudinal axis of the coupling.

28. The method of claim 23 wherein the dog has a lower surface and the first and the second profiles each have a lower surface having an angle that cooperate to apply a radially outward force to the dog in reaction to a down force applied to the dog.

29. The method of claim 23 wherein the dog has an upper surface and the first and the second profiles each have an upper surface having an angle that cooperate to apply a radially inward force to the dog in reaction to an upward force applied to the dog.

* * * * *